United States Patent [19]

Grant

[11] Patent Number: 4,834,625

[45] Date of Patent: May 30, 1989

[54] CERAMIC SOUND DAMPENING ENCASEMENT FOR FLUID PUMP

[75] Inventor: Benton H. Grant, Stamford, Conn.

[73] Assignee: Grant Airmass Corporation, Stamford, Conn.

[21] Appl. No.: 230,462

[22] Filed: Aug. 15, 1988

[51] Int. Cl.[4] ..... F04B 39/12

[52] U.S. Cl. ..... 417/413; 417/572; 417/DIG. 1; 417/902; 181/202

[58] Field of Search ..... 417/413, 902, DIG. 1, 417/572; 181/200, 201, 202; 62/508, 296

[56] References Cited

U.S. PATENT DOCUMENTS

| | | | |
|---|---|---|---|
| 3,266,716 | 8/1966 | Tussey | 230/55 |
| 3,371,852 | 3/1968 | Holt | 230/55 |
| 3,536,149 | 10/1970 | Laird | 181/202 |
| 3,669,573 | 6/1972 | Levensohn | 417/416 |
| 3,989,415 | 11/1976 | Van-Hee et al. | 417/312 |
| 4,352,642 | 10/1982 | Murayama et al. | 417/312 |
| 4,384,635 | 5/1983 | Lowery | 181/202 |
| 4,610,608 | 9/1986 | Grant | 417/413 |

*Primary Examiner*—Carlton R. Croyle
*Assistant Examiner*—David W. Scheuermann
*Attorney, Agent, or Firm*—St. Onge, Steward, Johnston & Reens

[57] ABSTRACT

An improved fluid pump provided with a ceramic encasement that substantially reduces noise and vibration, resulting in improved acoustic characteristics.

9 Claims, 3 Drawing Sheets

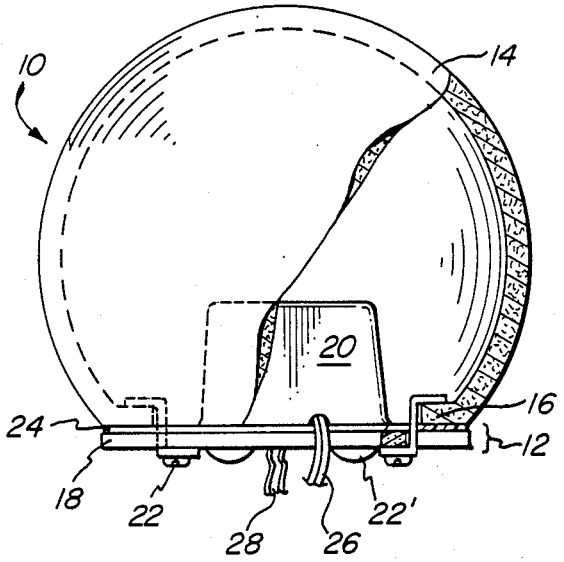
FIG. 1B
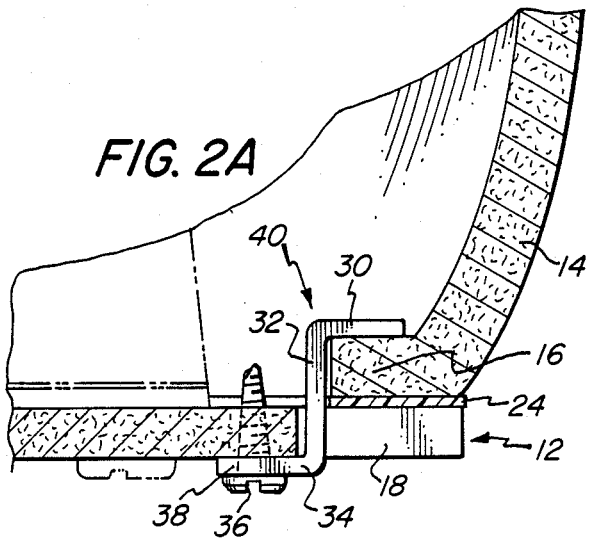

CERAMIC SOUND DAMPENING ENCASEMENT FOR FLUID PUMP

FIELD OF INVENTION

This invention relates generally to fluid pumps, such as an air pump. More particularly, an improved encasement is provided for improving the acoustic characteristics of such pumps.

BACKGROUND OF INVENTION

Suppression of noise from small air pumps, which can be used for example in such widely varying applications as health care devices and household aquaria, has long been desirable because even relatively low level acoustical emissions in a home or hospital environment can be disturbing. Despite advances in the construction of small air pumps, noise and vibration have continued to produce undesirable acoustic characteristics.

References showing a variety of pump constructions are shown in U.S. Pat. Nos. 3,669,573; 3,371,852; and 3,266,716.

SUMMARY OF INVENTION

In accordance with a preferred embodiment of the present invention, a fluid pump is provided with a ceramic encasement that substantially reduces noise and vibration, thereby resulting in improved acoustical characteristics.

It is an object of the present invention to provide encasements for a fluid pump that are relatively inexpensive to manufacture and can serve a decorative function as well.

It is a further object of the present invention to provide a modular encasement design that can be interchanged with other encasements of the same design relatively quickly and easily.

BRIEF DESCRIPTION OF THE DRAWINGS

The present invention will be better understood and its advantages will become apparent from the following detailed description of the preferred embodiment, especially when read in light of the accompanying drawings, wherein:

FIG. 1B is a partially-cut-away view of the pump of FIG. 1A in an assembled state;

FIG. 2A is a cross-sectional view depicting one preferred means for securing the base to the encasement according to the preferred embodiment;

DETAILED DESCRIPTION

Figure 1A:
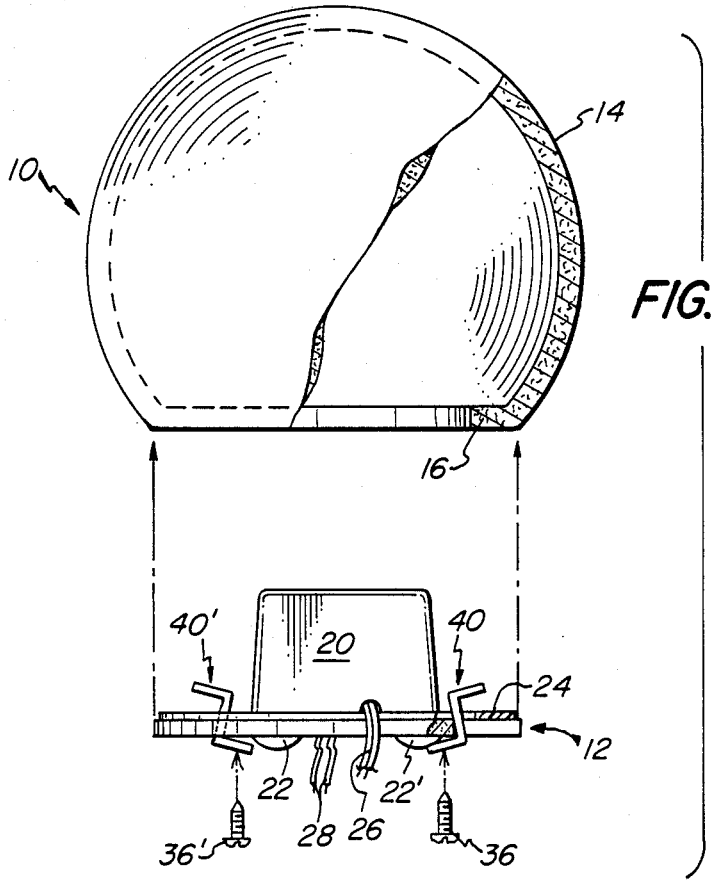
FIG. 1A is a partially-exploded, partially-cut-away front view of the pump of the present invention.

Referring to FIG. 1A, there is generally shown the preferred embodiment of a fluid pump at 10 in an exploded view. Fluid pump 10 includes a base, shown generally at 12, and a ceramic encasement shown generally at 14. Encasement 14 is preferably formed from vitreous or ceramic type materials such as pottery, glass, or the like. The modular assembly of the fluid pump 10 permits not only relatively quick and easy replacement of the ceramic encasement 14, but also relatively easy access to the pumping mechanism shown generally at 20. According to the preferred embodiment, the modularity of the fluid pump is achieved by two clips 40 and 40' that clamp base 12 relatively snugly to lip 16 formed in encasement 14. It is understood, however, that only one clamping clip is necessary where the other clip is permanently fixed to the lid. According to the preferred embodiment, ceramic encasement 14 is substantially spheroidal in shape, has an approximate diameter of 5 inches and is glazed on both the inside and outside surfaces. Further, encasement 14 is hollow, is approximately 3/16 inches thick, and is open to one side with lip 16 depending inwardly from the periphery of the opening. It is understood, however, that lip 16 could also depend outward. The opening in encasement 14 is approximately 4 inches in diameter, and the lip 16 is approximately ⅜ inches wide.

Referring to FIG. 1B, the pump 10 is shown in assembled form with a partial cutaway to show the pumping mechanism 20 therein. Base 12 comprises a lid 18 upon which is mounted pumping mechanism 20. According to the preferred embodiment, the shape of lid 18 is circular, but any shape that is appropriate to mate with lip 16 in a relatively snug fit can be used. Lid 18 is also provided with a circular gasket 24 of rubberized material or the like that aids in sealing the perimeter of lid 18 to lip 16 and therefore encasement 14. Furthermore, lid 18 includes ports for a power cord 26 and conduit 28 for the egress of a fluid under pressure. Also shown attached to the lid 18 are a plurality of vibration absorbing feet of rubberized material or the like at 22 and 22'.

Figure 2B:
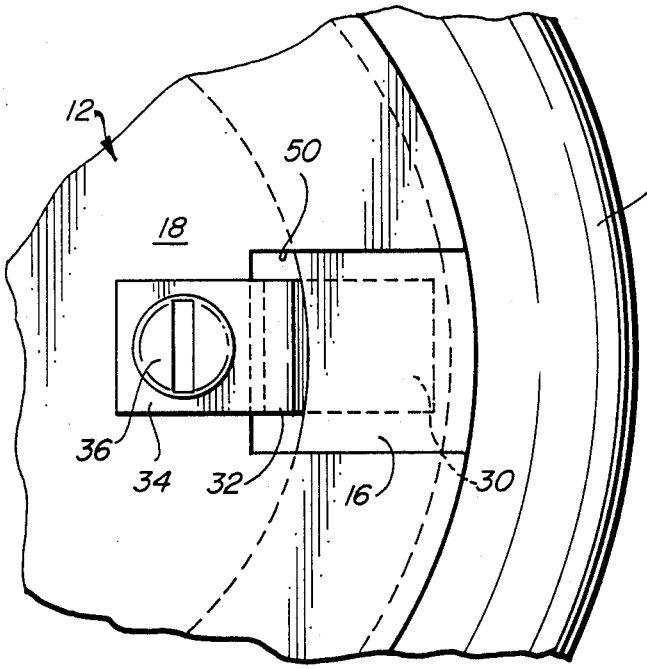
FIG. 2B is a further detailed view depicting one preferred means for securing the base to the encasement according to the preferred embodiment.

Referring now to FIG. 2A, a cross-sectional view is shown of the means for securing base 12 to encasement 14 according to the preferred embodiment. Lid 18 is clamped to lip 16, and thus encasement 14, by two or more clips 40. Each clip 40 comprises a body 32 that is long enough to traverse the width of lip 16 plus the thickness of lid 18. Clip 40 has two flanges, one each extending from opposite ends of body 32. One flange 30 depends outwardly, and one flange 34 depends inwardly and includes a hole 38. Lid 18 is securely clamped in a relatively snug fit with lip 16 and thus the encasement 14 when screw 36 draws flange 34 snug to lid 18, thereby forcing flange 30 snugly to lip 16. FIG. 2B is a bottom view that depicts additional detail of the means for securing base 12 to encasement 14. Notch 50 is formed in lid 18 to enable passage of clip body 32. It will be apparent that the clip 40 could also be screwed to the inside of lid 18 as well as the outside; however, the preferred embodiment not only provides additional clamping force, but also is easier to assemble and diassemble. Also while a notch is less expensive to form in lid 18, a slit, hole, or the like could serve the same function.

Figure 3:
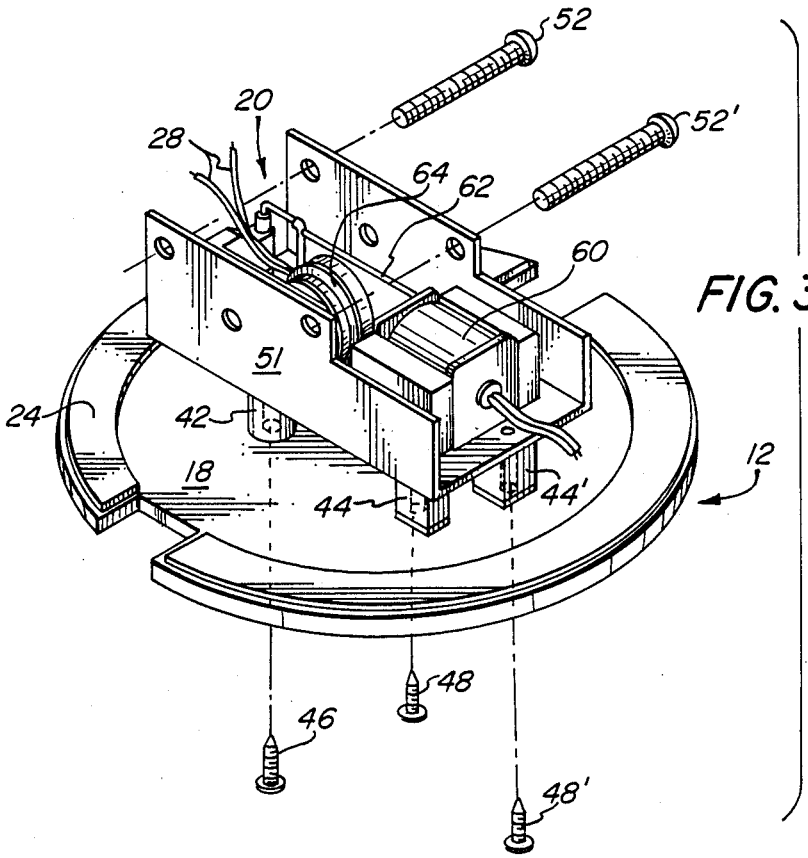
FIG. 3 is a partially-exploded, perspective view of the base.

Referring now to FIG. 3, a partially-exploded, perspective view of base 12 is revealed. Lid 18 is shown to bear mounting plate 54, provided for example as a single piece of stamped sheet metal with two 90 degree bends. According to the preferred embodiment, mounting plate 54 is adapted to receive pumping mechanism 20, which may be provided, for example, as in U.S. Pat. No. 4,610,608, having at least one diaphragm pump chamber 64, at least one actuator arm 62, and an electromagnet 60 with which to vibrate actuator arm 62 to reciprocate pump chamber 64 and create the pressurized fluid at 28. Two lateral support bolts 52 and 52' help to stabilize the plate 54. Means is also provided for attaching mounting plate 54 to lid 18. The preferred means for attachment include two rubber members 44 and 44' each of which bears a nut on both ends, and a piece of vinyl-plastic tubing 42. Bolts (not shown) are used to attach the mounting plate 54 to one end of the rubber members 44 and 44', and bolts 48 and 48' are used to attach the lid 18 to the other end of the rubber members 44 and 44' respectively. Two screws 46 and one not shown are used to tighten the vinyl-plastic tubing into two holes, one each in mounting plate 54 and lid 18. It is understood that other methods for attachment exist, including suspending mounting plate 54 by vibration absorbing springs, or the like.

The above description is for the purpose of teaching the person skilled in the art how to make and use the invention. This description is not meant to describe in detail each and every obvious modification and variation of the invention which will become apparent to the skilled worker upon reading the description. It is intended, however, to include all such modifications and variations within the scope of the invention which is defined by the following claims.

I claim:

1. A fluid pump having improved acoustic characteristics, said pump comprising:

(a) a base;

(b) means for delivering fluid under pressure from a fluid source, said fluid delivering means for mounting to said base; and (c) means for encasing said fluid delivering means, said encasing means forming a chamber open to one side for receiving and containing said fluid delivering means, said encasing means further having means formed in said side for mating with said base in a relatively snug fit, said encasing means being substantially formed from a ceramic material, whereby said fluid delivering means is relatively acoustically insulated.

2. The fluid pump of claim 1 wherein said base further comprises:

(a) a lid including means for securing said lid to said open side of said encasing means; and (b) a mounting plate, said mounting plate for mounting to said fluid delivering means, said mounting plate further having means for attaching to said lid.

3. The fluid pump of claim 2 wherein said means formed in said side of said encasing means further comprises a lip depending from the periphery of said open side of said encasing means for mating with said base in a relatively snug fit.

4. The fluid pump of claim 3 wherein said means for securing said lid to said encasing means further comprises at least one substantially Z-shaped clip having a body long enough to traverse the width of said lip and having two flanges, one depending inwardly and including a hole, and one depending outwardly from the opposite end of the body, said outward flange for engaging said lip, said inward flange for drawing relatively snugly to said lid with a fastening means passing through said hole and into said lid, whereby said lid is clamped in a relatively snug fit to said encasing means.

5. The fluid pump of claim 4 wherein said means for delivering a fluid under pressure further comprises an electric air pump of the type including:

(a) at least one diaphragm pump chamber;

(b) at least one actuator arm; and (c) at least one electromagnet means.

6. A fluid pump encasement having improved acoustic characteristics, said encasement comprising:

(a) a base;

(b) a hollow spheroid of substantially ceramic material forming a chamber open to one side, said open side having a lip depending from the periphery of said open side for mating with said base; and (c) means for clamping said base to said hollow spheroid in a relatively snug fit.

7. A fluid pump having improved acoustic characteristics, said pump comprising:

(a) a lid having two notches cut therein;

(b) an electric air pump, said electric air pump for mounting to said lid;

(c) an encasement substantially formed of a ceramic material and forming a chamber open to one side for receiving and containing said air pump, said open side further having a lip depending from the periphery of said open side for mating with said lid in a relatively snug fit;

(d) at least two substantially Z-shaped clips, each having a body long enough to traverse the width of said lip plus the thickness of said lid as it passes through said notch, and each having two flanges, one depending inwardly and including a hole, and one depending outwardly from opposite ends of the body, said outward flange for engaging said lip, said inward flange for drawing relatively snugly to said lid with a fastening means passing through said hole and into said lid, whereby said lid is clamped in a relatively snug fit to said encasement.

8. The fluid pump assembly of claim 7 wherein said lid further comprises a mounting plate, said mounting plate for mounting to said air pump, said mounting plate further having means for attaching to said lid.

9. The fluid pump assembly of claim 8 wherein said air pump further comprises:

(a) at least one diaphragm pump chamber; and (b) at least one electromagnet means.

* * * * *